US009989873B1

(12) United States Patent
Farrugia et al.

(10) Patent No.: US 9,989,873 B1
(45) Date of Patent: Jun. 5, 2018

(54) TONER COMPOSITIONS WITH ANTIPLASTICIZERS COMPRISING PURINE DERIVATIVE

(71) Applicant: Xerox Corporation, Norwalk, CT (US)

(72) Inventors: Valerie M. Farrugia, Oakville (CA); Richard Philip Nelson Veregin, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 0 days. days.

(21) Appl. No.: 15/499,217

(22) Filed: Apr. 27, 2017

(51) Int. Cl.

| | |
|---|---|
| ***G03G 9/093*** | (2006.01) |
| ***G03G 9/087*** | (2006.01) |
| ***G03G 9/08*** | (2006.01) |
| ***G03G 9/09*** | (2006.01) |

(52) U.S. Cl.
CPC ..... *G03G 9/09378* (2013.01); *G03G 9/0819* (2013.01); *G03G 9/0821* (2013.01); *G03G 9/0825* (2013.01); *G03G 9/0827* (2013.01); *G03G 9/08711* (2013.01); *G03G 9/08755* (2013.01); *G03G 9/0918* (2013.01); *G03G 9/09321* (2013.01); *G03G 9/09335* (2013.01); *G03G 9/09364* (2013.01); *G03G 9/09371* (2013.01); *G03G 9/09392* (2013.01)

(58) Field of Classification Search
CPC ..... G03G 9/09378; G03G 9/0918; G03G 9/08711; G03G 9/0821; G03G 9/0825; G03G 9/0819; G03G 9/08755; G03G 9/09371; G03G 9/09364; G03G 9/09335; G03G 9/09321; G03G 9/09392; G03G 9/0827
See application file for complete search history.

(56) References Cited

U.S. PATENT DOCUMENTS

| | | | |
|---|---|---|---|
| 4,457,998 | A | 7/1984 | Gruber et al. |
| 5,290,654 | A | 3/1994 | Sacripante et al. |
| 5,302,486 | A | 4/1994 | Patel et al. |
| 5,556,732 | A | 9/1996 | Chow |
| 6,063,827 | A | 5/2000 | Sacripante et al. |
| 7,524,602 | B2 | 4/2009 | Vanbesien et al. |
| 7,820,258 | B2 | 10/2010 | Shi et al. |

OTHER PUBLICATIONS

S. Anderson, E. Grulke, P. DeLassus, P. Smith, C. Kocher and B. Landes, "A Model for Antiplasticization in Polystyrene," Macromolecules, vol. 28, pp. 2944-2954, 1995.

*Primary Examiner* — Thorl Chea
(74) *Attorney, Agent, or Firm* — Pillsbury Winthrop Shaw Pittman LLP

(57) ABSTRACT

Disclosed herein include styrene-acrylic-based compositions containing a purine derivative antiplasticizer with particles having a core-shell type structure and methods for their preparation.

20 Claims, 6 Drawing Sheets

8G 2.0kV 8.7mm x10.0k SE(U) 6.00um 8G 2.0kV 8.7mm x3.00k SE(U) 10.0um 5.0kV 8.7mm x16.0k SE(U) 12/1/2015 3.00um 5.0kV 8.7mm x3.00k SE(U) 12/1/2016 10.0um 5.0kV 9.6mm x35.0k SE(U) 11/11/2016 3.00um 5.0kV 9.6mm x3.00k SE(U) 12/11/2015 10.0um 5.0kV 7.8mm x11.0k SE(U) 2/29/2016 5.00um 5.0kV 7.6mm x3.00k SE(U) 2/29/2016 10.0um 5.0kV 8.7mm x13.0k SE(U) 11/06/2016 4.00um 5.0kV 8.7mm x3.00k SE(U) 11/30/2016 10.0um

TONER COMPOSITIONS WITH ANTIPLASTICIZERS COMPRISING PURINE DERIVATIVE

BACKGROUND

The present disclosure relates to toner compositions with toner particles having a core-shell type structure and purine derivative antiplasticizers in the core and/or shell. More particularly, embodiments herein relate to hybrid toner compositions. The toner compositions described in the present disclosure prevent toner blocking phenomenon by controlling (e.g., lowering) the circularity of the toner particles. The avoidance of toner blocking leads to improvement of transfer efficiency, developability, cleanability, and flowability, which ultimately provide better print quality. More specifically, "lowering" the circularity of the toner particles means designing toner particles with less-than-spherical shape which translates to a circularity measurement of less than 1.00, or more specifically, less than or equal to 0.980, or between 0.940 to 0.980.

When toner is prepared using a pulverization method, it is inevitable that wax becomes embedded in the surface of the toner and protrudes outwardly during the pulverization step. This causes what is referred to as a toner blocking phenomenon, resulting in low image quality and poor storage stability of the toner. Blocking is a phenomena where toner is subject to a high temperature softens on its surface and toner particles coagulate or stick together. Once blocking occurs, the flowability during storage or in the developing unit radically drops, which makes transporting toner to the developing roller difficult and can be detrimental to image quality.

Various attempts have been made in the field to prevent toner blocking phenomenon, but have been unsuccessful. For example, replacing a high percentage amount (e.g., 40% by weight) of the polyester with styrene/acrylate did not help in lowering the circularity of the toner. Likewise, altering the conditions of the toner making process, such as for example, lowering the coalescence temperature or increasing the coalescing pH only worsen the surface morphology of the toner to change from semi-smooth to very rough, and did not change the toner circularity.

Therefore, there exists a need to prevent toner blocking phenomenon in toner compositions, while maintaining the right molecular weight for their fusing properties.

SUMMARY

According to embodiments illustrated herein, there is provided a composition comprising particles having a core and a shell disposed over the core, wherein the core comprises an optional first antiplasticizer; a first styrene-acrylate resin; and the shell comprises an optional second antiplasticizer; and a second styrene-acrylate resin; wherein the particles include at least one of the first antiplasticizer or the second antiplasticizer and further wherein at least one of the first antiplasticizer or the second antiplasticizer comprises a purine derivative.

In certain embodiments, there is provided a toner composition comprising toner particles having a core and a shell disposed over the core, wherein the core comprises caffeine in the amount of from about 0.1% to about 5% by weight of the total weight of the toner particles; a first styrene-acrylate resin; a polyester resin; and the shell comprises caffeine in the amount of from about 0.1% to about 5% by weight of the total weight of the toner particles; and a second styrene-acrylate resin.

In other embodiments, there is provided a method of making a toner comprising A method of making a plurality of toner particles comprising providing an emulsion comprising a resin, an optional colorant, and an optional wax, and an optional first antiplasticizer, wherein the resin comprises a first styrene-acrylate resin and a polyester resin; aggregating the emulsion to form particle cores; forming a shell over the particle cores to form particles, wherein the shell comprises an optional second antiplasticizer and a second styrene-acrylate resin; and coalescing the particles at a temperature from about 65° C. to about 80° C., and pH from about 3.5 to about 6.0; wherein at least one of the optional first antiplasticizer and the optional second antiplasticizer comprises a purine derivative, further wherein the toner particles having a circularity of from about 0.955 to about 0.980.

BRIEF DESCRIPTION OF THE DRAWINGS

For a better understanding of the present embodiments, reference may be made to the accompanying figures.

DETAILED DESCRIPTION

Figure 1:
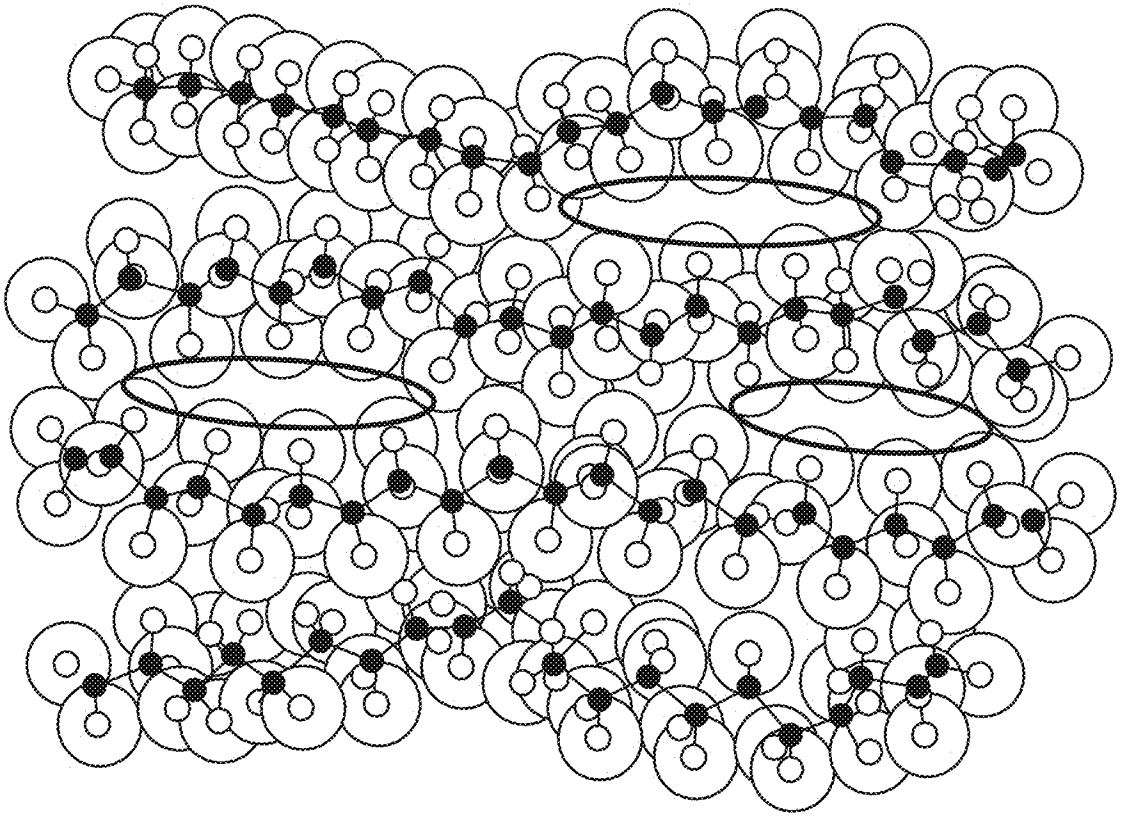
FIG. 1 is an illustration depicting a frame format of a polymer chain molecules clustered in an amorphous area. The gaps are created when the molecules gather (as seen by red ellipses); these gaps are called free volume.

In the following description, it is understood that other embodiments may be utilized and structural and operational changes may be made without departure from the scope of the present embodiments disclosed herein.

In this specification and the claims that follow, singular forms such as "a," "an," and "the" include plural forms unless the content clearly dictates otherwise. All ranges disclosed herein include, unless specifically indicated, all endpoints and intermediate values.

It has been found that the desire low circularity, such as from about 0.940 to about 0.980, from about 0.955 to about 0.980 or from about 0.968 to about 0.979, is not trivial to obtain with hybrid toners of the present disclosure. While not being limited by theory, it is believed during the process of preparing Emulsion Aggregation toners when the temperature is reached where the styrene-acrylate resin shell is properly coalesced, the styrene-acrylate core reduces to a low viscosity at the temperature required to ensure the St-Ac resin shell is properly coalesced which leads to high circularity. It is known in the art that high circularity can lead to poor blade cleaning, for example. Extensive research has been conducted and the results demonstrate that hybrid toners having a circularity of equal to or less than 0.979 may prevent problems such as developer loss from a developer housing having a trickle port. Highly spherical toner particles (e.g., >0.995, or >0.980) exhibit lower viscosity as compared to those less than "highly spherical" toner particles, and thus may cause the developer to flow out of the trickle port more than the design intent. The design intent is that if the developer housing has too much developer in it, it will empty through the trickle port reaching a stable level of developer. If replenisher is trickled in, a steady state will occur, so replenisher inflow matches developer outflow. In the case of having a toner circularity equals to or less than 0.979, the hybrid toner developer does not reach a stable equilibrium and the developer amount keeps decreasing in the housing. Thus, the loss of developer is excessive and may lead to high amount of developer waste.

Thus, there is a need to provide a hybrid toner with required lower circularity (equals to or less than 0.979), where the hybrid toner exhibits a smooth surface, good fusing latitude, especially mottle and HOT offset to the fuser roll, and good blocking and charging. A smooth surface is one where >90% of the toner surface is free of surface projections in the range of 500 nm to 1000 nm above and/or below the average surface plane. Good blocking is defined herein as at least 52° C., and in embodiments >53° C. Good fusing latitude is defined herein as a difference between the crease minimum fusing temperature and the mottle and HOT offset temperature of at least >40° C., in embodiments >50° C.

The present disclosure provides compositions including one or more purine derivative as antiplasticizer to help antiplasticize the resin, and thereby lowering the toner particle circularity. The toner circularity of the present toner particles are in the range of from about 0.940 to about 0.995, from about 0.955 to about 0.980 or from about 0.968 to about 0.979. The addition of the antiplasticizer of the present disclosure to the toner particles may reduce the circularity of the toner particles while maintaining a smooth surface without compromising on the toner performance.

Typical hybrid toners include both polyester and styrene-acrylate resins. For example, hybrid toners may contain a styrene/acrylate shell and a core comprising a styrene-acrylate copolymer and amorphous polyester. The polyester portion of the toner has a much lower viscosity and higher molecular mobility compared to the styrene/acrylate portion. A low molecular weight organic compound, such as, purine derivative, may be added to the toner core to help antiplasticize the polymers. An antiplasticized resin is described as a resin having a higher modulus, higher ultimate strength, lower ultimate elongation and lower glass transition temperature than its pure or neat version. The properties of an antiplasticized resin ultimately result from the reduction of its molecular mobility or its movement. Addition of small molecules (such as purine derivative of the present disclosure) to the polymer resin may reduce the mobility of polymer chains by filling just enough of the void space to inhibit phenyl ring flips while allowing enough mobility for realignment into a more densely packed state. See, S. Anderson, E. Grulke, P. DeLassus, P. Smith, C. Kocher and B. Landes, "A Model for Antiplasticization in Polystyrene," Macromolecules, vol. 28, pp. 2944-2954, 1995. Inventors of the present disclosure discover that including a compound of purine derivative in the toner may reduce the viscosity of the core material and slow spheroidization without compromising the shell texture. Therefore, the addition of the antiplasticizers of the present disclosure (i.e., purine derivative) may lower the circularity of the toner particles while maintaining a smooth surface and not compromising the toner performance.

Figure 2:
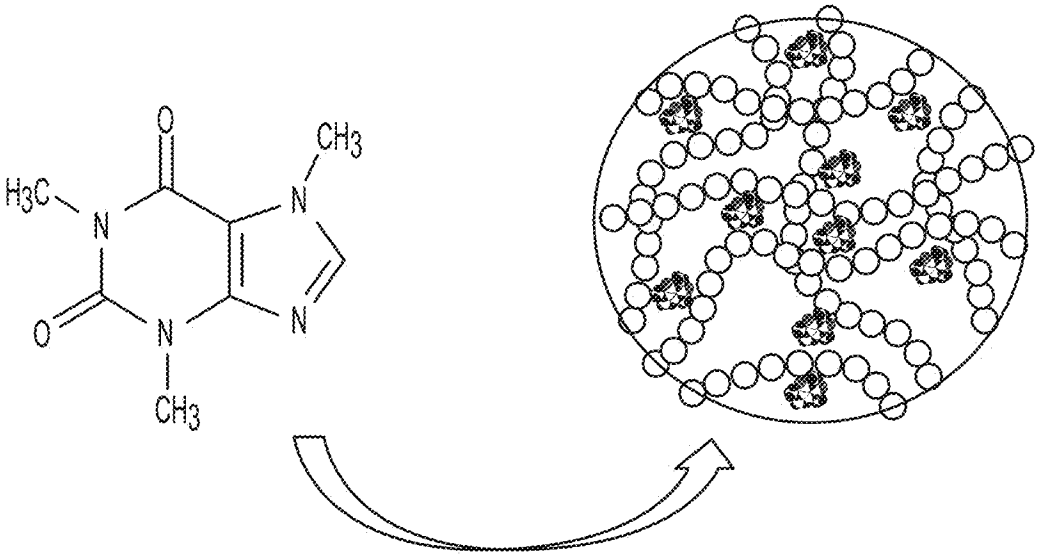
FIG. 2 is an illustration depicting a cluster of polymer molecules intermixed with a purine derivative according to one embodiment of the present disclosure (caffeine).

FIG. 1 shows a resin chain molecules clustered in an amorphous area. Gaps are created when the molecules gather (as seen by ellipses), and these gaps are referred to as free volume. The antiplasticizer of the present embodiments may be small organic molecules such as a purine derivative which allow them to penetrate into the free volume space of the polymer chains. FIG. 2 shows a cluster of polymer molecules intermixed with caffeine according to one embodiment of the present disclosure, where caffeine assumes a planar three-dimensional structure similar to the terephthalate groups in polyester. The hypothesis is that a synergistic attraction exists between caffeine and the terephthalate groups, such that a caffeine molecule may in fact interact with the terephthalates group in a way that hinders ring flipping.

Figure 3:
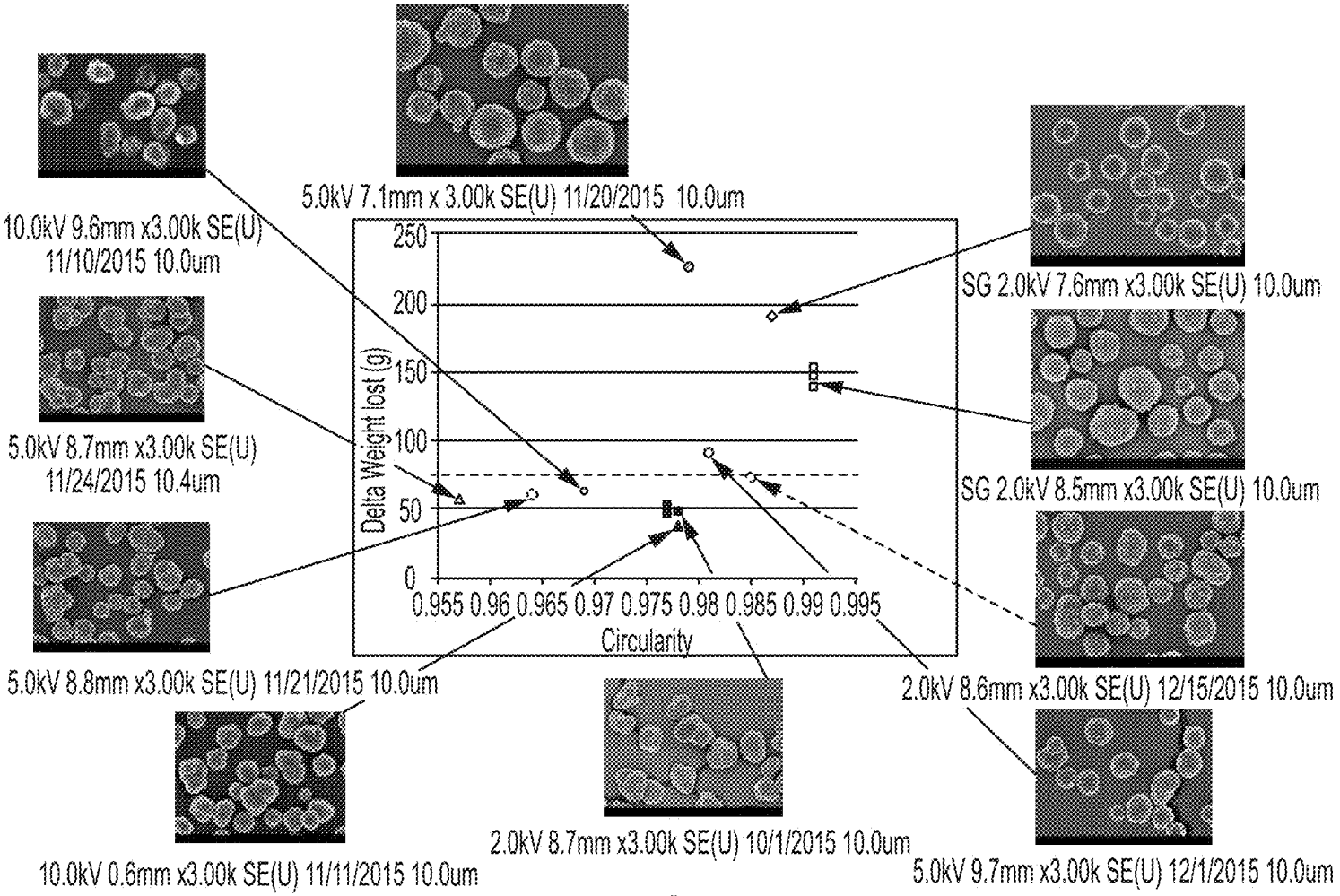
FIG. 3 is a graph illustrating the delta weight loss in grams of hybrid toners according to present embodiments with varying degree of circularity, and accompanying with SEM images of the hybrid toner particles.

One advantage of controlled circularity by the addition of purine derivative is the reduction of developer waste due to high flowing ("slippery") toner that escapes the trickle port. FIG. 3 shows the delta weight loss in grams of hybrid toners with varying degrees of circularity. The general trend verifies that toner greater than 0.975 (high end of production toner specification) has the greatest loss from the trickle port.

The antiplasticizer of the present disclosure may be included in the core, the shell, or both the core and the shell of the toner particles. The one or more antiplasticizer may be incorporated into the core of the composition, the one or more antiplasticizer may be incorporated into the shell of the composition, or the one or more antiplasticizer may be incorporated into both the core and the shell of the composition. In embodiments, the core includes a first antiplasticizer. In embodiments, the shell includes a second antiplasticizer. The first antiplasticizer may be the same or different from the second antiplasticize. The first antiplasticizer may include one or more antiplasiticizer. The second antiplasticizer may include one or more antiplasiticizer. In embodiments, the compositions of the present disclosure are toner compositions.

The antiplasticizer may be purine or a purine derivative. Examples of suitable purine derivative antiplasticizer of the present embodiments include, but are not limited to, adenine, guanine, hypoxanthine, xanthine, 1-methylxanthine, 3-methylxanthine, 7-methylxanthine, theophylline, paraxanthine, theobromine, caffeine, uric acid, 1,3,7-trimethyluric acid, theacrine, libertine, methylliberine, isoguanine, and mixtures thereof.

The amount of the first antiplasticizer included in the core can be from about 0.1 wt % to about 5 wt %, from about 0.2 wt % to about 4 wt %, or from about 0.5 wt % to about 3 wt % based on the total weight of the toner composition. The amount of the second antiplasticizer included in the shell can be from about 0.1 wt % to about 5 wt %, from about 0.2 wt % to about 4 wt %, or from about 0.5 wt % to about 3 wt % based on the total weight of the toner composition. The total amount of antiplasticizer (i.e., first antiplasticizer+second antiplasticizer) in the composition can be from about 0.1 wt % to about 10 wt %, from about 0.2 wt % to about 6 wt %, or from about 0.5 wt % to about 5 wt % based on the total weight of the toner composition.

Styrene-Acrylate Resin

The core may include a first styrene-acrylate resin. The shell may include a second styrene-acrylate resin. The first styrene-acrylate resin in the core and the second styrene-acrylate resin in the shell may be the same or different.

Illustrative examples of specific polymers for the first and second styrene-acrylate resins include, for example, poly (styrene-n-butyl acrylate), poly(styrene-alkyl acrylate), poly (styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), poly(styrene-1,3-diene), poly (styrene-1,3-diene-acrylic acid), poly (styrene-1,3-diene-acrylonitrile-acrylic acid), poly(styrene-butadiene), poly (methylstyrene-butadiene), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl methacrylate-acrylic acid), poly(butyl methacrylate-butyl acrylate), poly (butyl methacrylate-acrylic acid), poly(acrylonitrile-butyl acrylate-acrylic acid), and mixtures thereof. The alkyl group in the aforementioned polymers may be any alkyl group, and in particular may be a $C_1$-$C_{12}$ alkyl group, for example including methyl, ethyl, propyl and butyl. As the aryl group, any aryl group known in the art may be used.

In embodiments, the styrene-acrylate resin of the core has a weight-average molecular weight (Mw) value ranging from 15k to 70k. In embodiments, the styrene acrylate resin of the core has a number-average molecular weight (Mn) value ranging from 10k to 60k. In embodiments, styrene acrylate resin of the core has a polydispersity index (Mw/Mn) value ranging from 1.5 to 10. In embodiments, the styrene-acrylate resin of the shell has a weight-average molecular weight (Mw) value ranging from 15k to 70k. In embodiments, the styrene acrylate resin of the shell has a number-average molecular weight (Mn) value ranging from 10k to 60k. In embodiments, styrene acrylate resin of the shell has a polydispersity index (Mw/Mn) value ranging from 1.5 to 10.

In embodiments, the styrene-acrylate resin in the core and the styrene-acrylate resin in the shell may be, independently, styrene-alkyl acrylate, more particularly a styrene-butyl acrylate polymer such as a styrene-butyl acrylate polymer.

In embodiments, the styrene-acrylate resin in the core includes styrene and n-butyl acrylate. In embodiments, the styrene-acrylate resin in the shell includes styrene and n-butyl acrylate.

In embodiments, the styrene-acrylate resin in the core and the styrene-acrylate resin in the shell each include a styrene monomer and an acrylic monomer. As used herein, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic acid monomer" refers to acrylic acid, methacrylic acid, and β-CEA. As used herein, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

In embodiments, the styrene monomer is present in the core in an amount of from about 4 to about 50, or from about 7 to about 40 weight percent by total weight of the composition. In embodiments, the acrylic ester monomer is present in the core in an amount of from about 1 to about 30, or from about 2 to about 18 weight percent by total weight of the composition. In embodiments, the styrene monomer is present in the shell in an amount of from about 4 to about 40, or from about 6 to about 30 weight percent by total weight of the composition. In embodiments, the acrylic ester monomer is present in the shell in an amount of from about 0.5 to about 30, or from about 1 to about 25 weight percent by total weight of the composition.

In embodiments, the first styrene-acrylate resin is present in the core in an amount of from about 7 to about 60 percent, from about 10 to about 50 percent, from about 20 to about 45 percent, or from about 25 to about 40 percent by weight of the total weight of the composition. In embodiments, the second styrene-acrylate resin is present in the shell in an amount of from about 3 to about 20 percent, from about 5 to about 15 percent, from about 8 to about 13 percent, by weight of the total weight of the composition.

The styrene-acrylate resin in the core may have a mean particle size of from about 100 nm to about 250 nm, from about 100 nm to about 140 nm, from about 140 nm to about 200 nm, or from about 140 to about 250 nm.

The styrene-acrylate resin in the shell may have a mean particle size of from about 100 nm to about 250 nm, from about 100 nm to about 140 nm, from about 140 nm to about 200 nm, or from about 140 to about 250 nm.

Amorphous Polyester Resin

The toner composition of the present disclosure include core particles comprises an amorphous polyester resin. The amorphous polyester resin may be formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin. In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

(I)

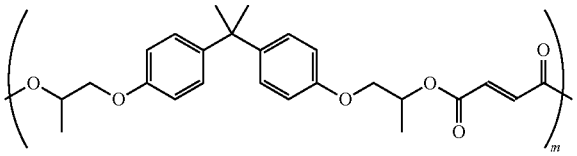

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, the resins utilized as the resin coating may have a glass transition temperature of from about 30° C. to about 80° C., in embodiments from about 35° C. to about 70° C. In further embodiments, the resins utilized as the resin coating may have a melt viscosity of from about 10 to about 1,000,000 Pa*S at about 130° C., in embodiments from about 20 to about 100,000 Pa*S.

The amorphous polyester resin may be present in the core, for example, in an amount of from about 10 to about 95 percent by weight of the total weight of the toner, in embodiments from about 20 to about 80 percent by weight, or from about 40 to about 70 percent by weight of the total weight of the toner.

Crystalline Polyester Resin

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

The crystalline polyester resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The crystalline polyester resin may be present in the core, for example, in an amount of from about 5 to about 50 percent by weight of the total weight of the toner components, in embodiments from about 10 to about 35 percent by weight of the total weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Surfactants

Any suitable surfactants may be used for the preparation of the latex and wax dispersions according to the present disclosure. Depending on the emulsion system, any desired nonionic or ionic surfactant such as anionic or cationic surfactant may be contemplated.

Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$ and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890®, and ANTAROX 897®) and the like, as well as mixtures thereof.

Initiators

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; tert-butyl permethoxyacetate; tert-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonod-initrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly (tetraethylene glycol-2,2'-azobisisobutyrate); 1,4-bis (pentaethylene)-2-tetrazene; 1,4-dimethoxycarbonyl-1,4-dipheny-l-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments, the chain transfer agent has a carbon-sulfur covalent bond. The carbon-sulfur covalent bond has an absorption peak in a wave number region ranging from 500 to 800 cm-1 in an infrared absorption spectrum. When the chain transfer agent is incorporated into the latex and the toner made from the latex, the absorption peak may be changed, for example, to a wave number region of 400 to 4,000 cm-1.

Exemplary chain transfer agents include, but are not limited to, n-C3-15 alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Colorants

Various known suitable colorants, such as dyes, pigments, mixtures of dyes, mixtures of pigments, mixtures of dyes and pigments and the like may be included in the toner. The colorant may be included in the toner in an amount of, for example, about 0.1 to about 35% by weight of the toner, from about 1 to about 15% percent of the toner, from about 3 to about 10% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1 wt % to about 25 wt % of the toner particles, in embodiments, from about 5 wt % to about 20 wt % of the total weight of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, camauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

The toner particles of the present embodiments exhibits a dielectric loss of from about 20 to about 80, or from about 50 to about 70, or from about 40 to about 45.

The toners of the present embodiments has a minimum fusing temperature (MFT) of from about 90 to about 150, or from about 100 to about 130, or from about 100 to about 125. The toner particles of the present embodiments exhibits a gloss from about 10 ggu to about 60 ggu, from about 20 ggu to about 70 ggu, or from about 30 ggu to about 70 ggu on plain paper The toner particles of the present embodiments have an average particle size of from about 4 μm to about 10 μm, from about 4 μm to about 7 μm, or from about 4 μm to about 20 μm The toner particles of the present embodiments have an average circularity of from about 0.93 to about 0.99, from about 0.96 to about 0.98, or from about 0.95 to about 0.99. The toner particles of the present embodiments have a shape factor of from about 120 to about 140, from about 110 to about 130, or from about 105 to about 150. The toner particles of the present embodiments have a volume geometric standard deviation for (D84/D50) in the range of from about 1.15 to about 1.25, from about 1.15 to about 1.30, or from about 1.20 to about 1.25. The toner particles of the present embodiments have a number geometric standard deviation for (D16/D50) in the range of from about 1.15 to about 1.25, from about 1.15 to about 1.30, or from about 1.20 to about 1.25.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which smaller-sized resin particles are aggregated to the appropriate toner particle size and then coalesced to achieve the final toner particle shape and morphology.

In embodiments, toner compositions may be prepared by emulsion-aggregation processes, such as, a process that includes aggregating a mixture of an optional wax and any other desired or required additives, and emulsions including the resins described above, optionally with surfactants, as described above, and then coalescing the aggregate mixture. A mixture may be prepared by adding an optional wax or other materials, which optionally also may be in a dispersion (s) including a surfactant, to the emulsion, which may be a mixture of two or more emulsions containing the resin. The pH of the resulting mixture may be adjusted by an acid (i.e., a pH adjustor) such as, for example, acetic acid, nitric acid or the like. In embodiments, the pH of the mixture may be adjusted to from about 2 to about 6. In embodiments, the pH of the mixture may be adjusted to from about 3 to about 5. In embodiments, the pH of the mixture may be adjusted to from about 4 to about 5. In embodiments, the pH of the mixture may be adjusted to from about 5 to about 6. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer or a Gaulin 15MR homgenizer.

Following preparation of the above mixture, generally, an aggregating agent may be added to the mixture. Suitable aggregating agents include, for example, aqueous solutions of a divalent cation or a multivalent cation material. In the present embodiments, a polyaluminum halide, specifically, polyaluminum chloride (PAC) is used. PAC is a stronger multivalent flocculant as compared to aluminum sulfate, which is a bivalent flocculant. It was discovered that the PAC unexpectedly improves the surface morphology by reducing the amount of styrene-acrylate on the surface. It is believed that the multivalent PAC helps bind and keep the higher acid value styrene-acrylate latex to the core of the toner particles.

In using the PAC, the manufacturing process is modified to lengthen the coalescence time (as compared to that used with conventional flocculants like aluminum sulfate) to from about 1 hour to about 3 hours, or from about 1.5 hours to about 2.5 hours. It was discovered that this modification of longer coalescence time is needed to smooth the toner surface and obtain optimal surface morphology.

Other aggregating agents that may be used include the corresponding bromide, fluoride or iodide, and combinations thereof. In embodiments, the aggregating agent is present in the toner composition in an amount of from about 0.1 to about 1.0 percent, or of from about 0.2 to about 0.8 percent, or of from about 0.25 to about 0.5 percent by weight of the total weight of the toner particles. In embodiments, the aggregating agent may be added to the mixture at a temperature that is below the glass transition temperature (Tg) of the resin. As discussed above, the reduced coalescence temperature used is from about 70 to about 90° C., or from about 70 to about 80° C., or from about 70 to about 77° C.

The aggregating agent may be added to the mixture to form a toner in an amount of, for example, from about 0.1 parts per hundred (pph) to about 1 pph of the toner particles, in embodiments, from about 0.25 pph to about 0.75 pph of the toner particles.

The gloss of a toner may be influenced by the amount of retained metal ion, such as, $Al^{3+}$, in the particle. The amount of retained metal ion may be adjusted further by the addition of ethylene diamine tetraacetic acid (EDTA). In embodiments, the amount of retained metal ion, for example, $Al^{3+}$, in toner particles of the present disclosure may be from about 0.1 pph to about 1 pph, in embodiments, from about 0.25 pph to about 0.8 pph.

The disclosure also provides a melt mixing process to produce low cost and safe cross-linked thermoplastic binder resins for toner compositions which have, for example, low fix temperature and/or high offset temperature, and which may show minimized or substantially no vinyl offset. In the process, unsaturated base polyester resins or polymers are melt blended, that is, in the molten state under high shear conditions producing substantially uniformly dispersed toner constituents, and which process provides a resin blend and toner product with optimized gloss properties (see, e.g., U.S. Pat. No. 5,556,732, herein incorporated by reference in entirety). By, "highly cross-linked," is meant that the polymer involved is substantially cross-linked, that is, equal to or above the gel point. As used herein, "gel point," means the point where the polymer is no longer soluble in solution (see, e.g., U.S. Pat. No. 4,457,998, herein incorporated by reference in entirety).

To control aggregation and coalescence of the particles, in embodiments, the aggregating agent may be metered into the mixture over time. For example, the agent may be metered into the mixture over a period of from about 5 to about 240 min, in embodiments, from about 30 to about 200 min. Addition of the agent may also be done while the mixture is maintained under stirred conditions, in embodiments from about 50 rpm to about 1,000 rpm, in embodiments, from about 100 rpm to about 500 rpm, and at a temperature that is below the Tg of the resin.

The particles may be permitted to aggregate until a predetermined desired particle size is obtained. A predetermined desired size refers to the desired particle size as determined prior to formation, with particle size monitored during the growth process as known in the art until such particle size is achieved. Samples may be taken during the growth process and analyzed, for example with a Coulter Counter, for average particle size. The aggregation thus may proceed by maintaining the elevated temperature, or slowly raising the temperature to, for example, from about 40° C. to about 65° C., and holding the mixture at that temperature for a time from about 0.5 hour to about 6 hour, in embodiments, from about 1 hour to about 5 hour, while maintaining stirring, to provide the aggregated particles. Once the predetermined desired particle size is obtained, the growth process is halted. In embodiments, the predetermined desired particle size is within the toner particle size ranges mentioned above. In embodiments, the particle size may be about 5.0 to about 6.0 μm, about 6.0 to about 6.5 μm, about 6.5 to about 7.0 μm, about 7.0 to about 7.5 μm.

Growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 38° C. to about 55° C., in embodiments, from about 40° C. to about 50° C., which may be below the Tg of the resin.

Following aggregation to the desired particle size, with the optional formation of a shell as described above, the particles then may be coalesced to the desired final shape, the coalescence being achieved by, for example, heating the mixture to a temperature of from about 65° C. to about 90° C., in embodiments from about 70° C. to about 80° C., in embodiments from about 68° C. to about 72° C., in embodiments from about 72° C. to about 78° C., which may be below the melting point of a crystalline resin to prevent plasticization. Higher or lower temperatures may be used, it being understood that the temperature is a function of the resins used.

Coalescence may proceed over a period of from about 0.1 to about 9 hour, in embodiments, from about 0.5 to about 4 hour.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

The (dry) toner particles of the present disclosure have a circularity of from about 0.940 to about 0.995, from about 0.955 to about 0.980, or from about 0.968 to about 0.975. Circularity may be determined with a Sysmex FPIA-3000 Particle Characterization System from Malvern Instruments Ltd. (Worcestershire, UK).

EXAMPLES

Example 1

Preparation of Core Toner Latex with 1.18% Caffeine Relative to Total Binder Resin in Toner.

A solution of 6.67 g caffeine in 0.3M nitric acid was prepared. The total weight of the solution was 111.91 g (5.96-wt % caffeine). In a 2 L glass reactor, 93.66 g of amorphous polyester emulsion A, 92.92 g of amorphous polyester emulsion B, and 18.41 g of caffeine solution were combined. Then 79.03 g of styrene-acrylate latex emulsion C was added to reactor followed by 29.65 g of crystalline polyester emulsion D. Another 3.40 g of the caffeine solution was added followed by 20.12 g of polyethylene wax, 10.72 g of cyan pigment (PB15:3), 55.45 g of black pigment (Nipex-35) and 248.02 g of DI water. Another 4.67 g of caffeine solution was added to the slurry, as well as the remaining 434 g of DI water.

Preparation of Hybrid Toner Containing 1.18% Caffeine in Core

To the 2 L glass reactor containing the latex emulsion prepared above was added 2.70 g of PAC (poly-aluminum chloride) was mixed with 33.30 g of 0.02M nitric acid, and then added to the slurry under homogenization at 3000-4000 RPM, and the pH was adjusted from 7.47 to 3.04 during the addition of caffeine in 0.3M nitric acid in previous step. The reactor was set to 370 RPM and was heated to 38° C. to aggregate the toner particles. When the particle size reached 5-6 μm, a shell coating was added which contained 47.24 g styrene-acrylate latex emulsion C, the stirring speed was reduced to 200 RPM. The reaction mixture was further heated to 43° C. When the toner particle size reached about 6 microns, the stirring speed was lowered further to 70 RPM and freezing began by pH adjusting the slurry with 12.09 grams of a chelating agent (Versene100) until pH reaches 7.00. The reactor temperature was ramped to 69° C. Once at 69° C., the pH of the slurry was reduced from 7.03 to 4.00 with 81.39 g of 0.3M nitric acid. The reactor temperature was further ramped to 75° C. Once at the coalescence temperature, the slurry was coalesced for 90 minutes until the particle circularity is between 0.968-0.975 as measured by the Flow Particle Image Analysis (FPIA) instrument. The slurry was then quench cooled in 718.6 g DI ice. The final particle size was 5.51 microns, GSDv 1.22, GSDn 1.44 and a circularity of 0.970. The toner was then washed and freeze-dried.

Example 2

Preparation of Hybrid Toner Containing 2% Caffeine in Shell

In a 2 L reactor, 83.69 g of amorphous polyester emulsion A 82.85 g of amorphous polyester emulsion B, 107.85 g styrene-acrylate latex C, 31.73 g crystalline polyester emulsion D, 20.16 g paraffin wax, 9.91 g cyan pigment (PB15:3), 54.54 g black pigment (Nipex®-35) and 727.12 g DI water were combined to form a slurry. Subsequently, 2.70 g of PAC (poly-aluminum chloride) was mixed with 33.30 g 0.02M nitric acid and then added to the slurry under homogenization at 3000-6400 RPM; no pH adjustment was performed since the pH was inherently 4.11. The reactor stirrer was set to 270 RPM and was heated to 48° C. to aggregate the toner particles. When the toner particle size reached 4.8-5 μm, a shell coating was added which contained 37.34 g styrene-acrylate latex C and 0.3 g caffeine, which were premixed together before adding to the reactor. The reaction was further heated to 50° C. When the toner particle size reached 5.6-6 microns, freezing began with the pH of the slurry being adjusted to 7.80 using 12.52 g of Versene 100 (EDTA). The reactor RPM was then decreased to 46 during this time and 6.42 g of Tayca Power anionic surfactant was added to reduce further particle aggregation during coalescence step. The reactor temperature was ramped to 70° C. Once the temperature reached 70° C., the pH of the slurry was reduced from 7.41 to 4.00 with 84.53 g 0.3M nitric acid. The reactor temperature was further ramped to 75° C. Once the temperature reached the coalescence temperature, the slurry was coalesced for about 90 minutes. The slurry was then quenched and cooled in 658.5 g DI ice. The final particle size was 5.89 microns, GSDv 1.23, GSDn 1.42 and a circularity of 0.967 as measured by the Flow Particle Image Analysis (FPIA) The toner was then washed and freeze-dried.

Example 3

Preparation of Comparative Example 1

Control Toner Example 1 was prepared using the same process described in Example 1 except that no purine derivative was added to the core and the wax used was N539 Paraffin wax instead of the IGI polyethylene wax. Control Toner Example 1 was coalesced at 75° C., pH 0.5.5 for 90 minutes with a final particle size of 6.1 microns, GSDv 1.21, GSDn 1.29 and a circularity of 0.991.

Example 4

Preparation of Comparative Example 2

Control Toner Example 2 was prepared using the same process described in Example 2 except that no purine derivative was added to the shell. Control Toner Example 3 was coalesced at 75° C., pH 4 for 90 minutes with a final particle size of 5.8 microns, GSDv 1.22, GSDn 1.24 and a circularity of 0.981.

Example 5

Preparation of Comparative Example 3

Control Toner Example 3 was prepared using the same process described in Example 2 except that no purine derivative was added to the core. Control Toner Example 3 was coalesced at 70° C., pH 4 for 90 minutes with a final particle size of 5.7 microns, GSDv 1.21, GSDn 1.23 and a circularity of 0.971.

Example 6

Preparation of Comparative Example 4

Control Toner Example 4 was prepared using the same process described in Example 2 except that no purine derivative was added to the core. Control Toner Example 3 was coalesced at 80° C., pH 4 for 90 minutes with a final particle size of 6.3 microns, GSDv 1.22, GSDn 1.21 and a circularity of 0.987.

Example 7

Toner Evaluation

Bench developer performance was obtained for both the parent toner particles (i.e., without any external toner additives), and of a toner blended with a set of external additives.

Toner Additive Blending

For each sample, about 50 g of the toner were added to an SKM mill along with an additive package including silica, titania and zinc stearate and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging

Toner charging was collected for both the parent toner particle without any surface additives and for the blended toner particle with surface additives. For parent toner particles 5 pph of toner in carrier was prepared, 1.5 grams of toner and 30 grams of XEROX® 700 carrier in a 60 mL glass bottle, for the blended toner at 6 pph of toner in carrier, 1.8 grams of toner and 30 grams of Xerox 700 carrier in a 60 mL glass bottle. Samples were conditioned three days in a low-humidity zone (J zone) at 21.1° C. and 10% RH), and in a separate sample in a high humidity zone (A zone) at about 28° C./85% relative humidity. The developers with parent toner particles were charged in a Turbula mixer for 10 minutes, the developers with additive blended toner were charged in a Turbula mixer for 60 minutes.

Toner Blocking

Toner blocking was determined by measuring the toner cohesion at elevated temperature above room temperature. Toner blocking measurement is completed as follows: two grams of additive toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves were vibrated for about 90 seconds at about 1 mm amplitude with a Hosokawa flow tester.

Developer Loss Procedure

A Xerox 700 developer housing was filled with about 1600 grams of developer at 8 wt % TC. The housing with developer was weighed. 500 blank pages were printed, stopping every 100 prints to weigh the developer housing. For circularity less than or equal to 0.979 the developer amount in the housing stabilized near 1540 grams. For circularity greater than 0.979 the developer amount continued to decrease, and did not reach a stable value at 500 prints.

Figure 4A:
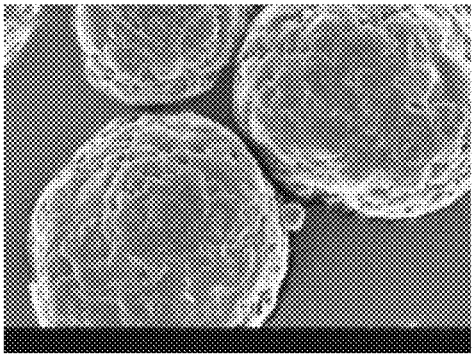
FIGS. 4*a* and 4*b* are scanning electron microscope (SEM) images showing the morphology of the hybrid toner of Comparative Example 1 made without antiplasticizers of the present disclosure.
Figure 4B:
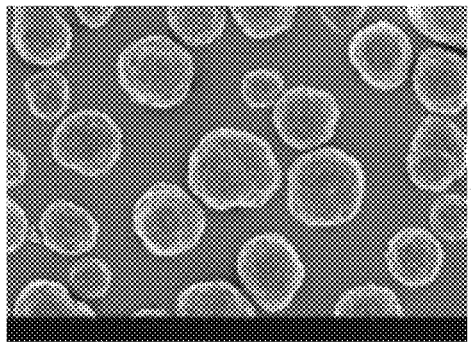
Figure 5A:
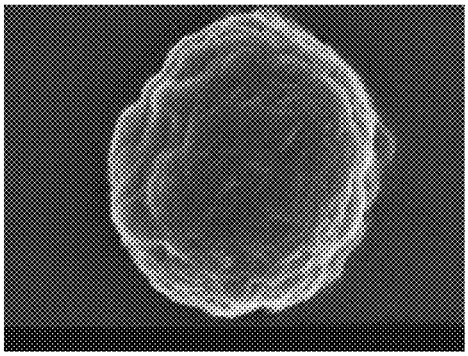
FIGS. 5*a* and 5*b* are scanning electron microscope (SEM) images showing the morphology of the hybrid toner of Comparative Example 2 made without antiplasticizers of the present disclosure.
Figure 5B:
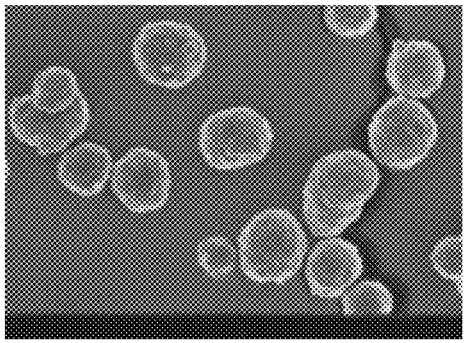
Figure 6A:
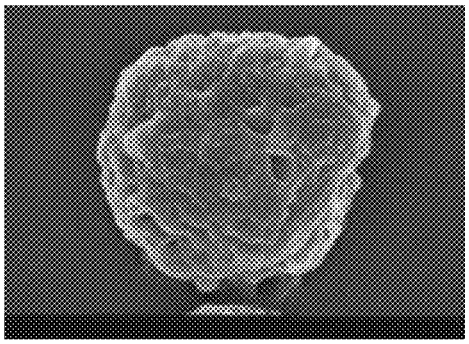
FIGS. 6*a* and 6*b* are scanning electron microscope (SEM) images showing the morphology of the hybrid toner of Comparative Example 3 made without antiplasticizers of the present disclosure.
Figure 6B:
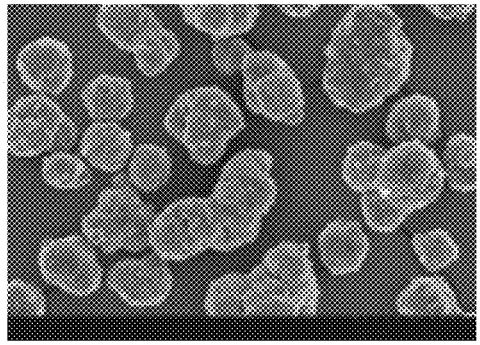

It was found that hybrid toner made with 30% poly (styrene-n-butyl acrylate) using coalescence conditions of pH 5.5 at 75° C. with paraffin wax (Comparative Example 1) resulted in very spherical toner with a marginally rough surface morphology, which was observed using microscopy (e.g., scanning electron microscope). FIGS. 4*a* and 4*b* are scanning electron microscope (SEM) images showing the morphology of the hybrid toner of Comparative Example 1. Toner made with 40% poly(styrene-n-butyl acrylate (Comparative Examples 2 and 3) showed improvements in terms of circularity when compared to toner particles having 30% poly(styrene-n-butyl acrylate) in the core (Comparative Example 1). As shown in Table 1, Comparative Examples 2 still exhibits a high toner circularity (0.981) with 75° C. coalescence. When the coalescence temperature was reduced to 70° C., other tradeoffs occurred. For example, Comparative Example 3 exhibits a lower toner circularity (0.971), which is acceptable as a result of the lower temperature of coalescence; however the toner surface was more rough. A rough surface increases the toner surface area which can lead to lower effective additive coverage, and in turn causes the effect of the toner surface additives to degrade. The lower effective additive coverage can also lead to poor aging performance when the toner circulates in the developer housing for long periods of time FIGS. 5*a* and 5*b* are scanning electron microscope (SEM) images showing the morphology of the hybrid toner of Comparative Example 2 made without antiplasticizer of the present disclosure. FIGS. 6*a* and 6*b* are scanning electron microscope (SEM) images showing the morphology of the hybrid toner of Comparative Example 3 made without antiplasticizer of the present disclosure.

Figure 7A:
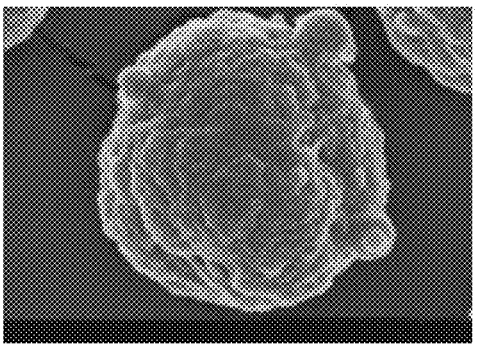
FIGS. 7*a* and 7*b* are scanning electron microscope (SEM) images showing the morphology of the hybrid toner of according to one embodiment of the present disclosure (containing 2% caffeine in the shell).
Figure 7B:
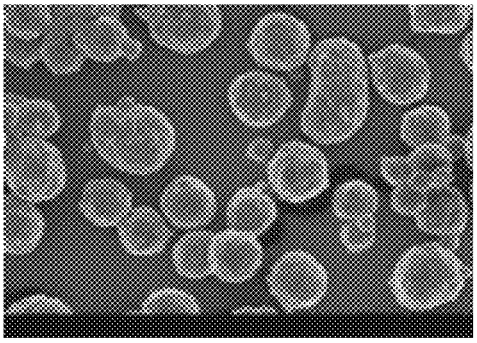

By adding 2% caffeine in the poly(styrene-n-butyl acrylate) shell (Example 2), an acceptable toner circularity was obtained with a 75° C. coalescence temperature. A notable improvement was seen in the surface morphology compared to Comparative Example 3 which showed similar acceptable circularity. FIGS. 7*a* and 7*b* are scanning electron microscope (SEM) images showing the morphology of the hybrid toner of Example 2 made with 2% caffeine in the shell. The caffeine transitioned from an "antiplasticizing-like" behavior to "plasticizing-like" behavior, because the caffeine loading was sufficiently high and localized to the shell component of the toner. The caffeine was unable to intermix with the core polyester resin to function as an "antiplasticizer" as seen in Example 1. When a lower concentration of caffeine was added to the bulk (core) of the toner, chain mobility was hindered thereby lowering the toner's viscosity at the coalescence temperature translating to less circular particles. The blocking in Example 2 (having a 75° C. coalescence temperature) is better than that in Comparative Example 3 (having a 70° C. coalescence temperature).

In Comparative Example 4, the wax was changed from paraffin wax to polyethylene wax. When coalesced at 80° C. with polyethylene wax the surface was very smooth, but the circularity is much too high. Also the mottle temperature in fusing was too low at 150° C., the worst of all the toners tested. The fusing latitude from MFT (133° C.) to mottle temperature (150° C.) was only 17° C., much too narrow a latitude to be functional in the fuser. While it is not desired to be limited by theory, it is understood that the coalescence temperature of 80° C. is lower than the wax melt point, so that the wax in the toner never fully melts and thus the wax domains do not grow and migrate sufficiently to the surface of the toner to provide good mottle temperature in the fuser. Also at 80° C. the resin flow particularly in the styrene-acrylate shell is relative low, so the wax domains cannot diffuse to the surface. To solve this the coalescence temperature needs to be increased to more fully melt the wax and to increase the resin flow, but this will only make the toner more spherical, and this toner is already to spherical.

Figure 8A:
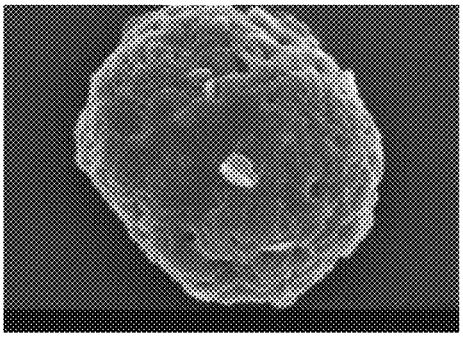
FIGS. 8*a* and 8*b* are scanning electron microscope (SEM) images showing the morphology of the hybrid toner of according to one embodiment of the present disclosure (containing 1.1% caffeine in the core).
Figure 8B:
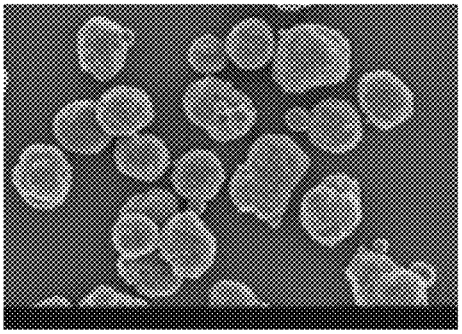

A less spherical toner with acceptable circularity was obtained when 1.1% caffeine was introduced into the core portion of the toner (Example 1) using the same polyethylene wax as in Comparative Example 4, and coalescing even at a lower 75° C. and pH=4. FIGS. 8*a* and 8*b* are scanning electron microscope (SEM) images showing the morphology of the hybrid toner of Example 1 made with 1.1% caffeine in the core. Other notable improvements include exhibiting good peak gloss (e.g., 60-65), similar MFT to the comparative samples, and excellent mottle and HOT offset and wide fusing latitude between crease MFT and mottle and HOT offset temperature. Blocking matched the Comparative Example 4 with the same wax since the caffeine's antiplasticizing effect in Example 1 filled the free volume between polymer chains which helped maintain chain rigidity but still allowed the resin to flow while approaching the toner's glass transition temperature and thereby allowing the wax to easily migrate to the toner's surface. While there was no improvement in terms of the blocking temperature, Example 1 is considered to be a better performing toner overall.

Table 1 summaries the toners' core and shell composition, coalescence condition and toner evaluation results.

TABLE 1

| | Hybrid Toner (Controls) | | | | Hybrid Toner containing Caffeine Antiplasticizer | |
|---|---|---|---|---|---|---|
| | Comparative Example 1 | Comparative Example 2 | Comparative Example 3 | Comparative Example 4 | Example 1 | Example 2 |
| Wax | 4% paraffin wax | 4% paraffin wax | 4% paraffin wax | 4% polyethylene wax | 4%-polyethylene wax | 4% paraffin wax |
| CPE | C10:C6 | C10:C6 | C10:C6 | C10:C6 | C10:C6 | C10:C6 |
| St-nBAc latex (Tg/Mw) | (55.3° C., 24.3K) | (55.3° C., 24.3K) | (55.3° C., 24.3K) | (55.3/24.3) | (55.3° C., 24.3K) | (55.3° C., 24.3K) |
| Core/Shell st-nBAc | 30%, 12.5% | 40%, 10% | 40%, 10% | 10%/28% | 30%, 12.5% | 40%, 10% |
| Other additives | | | | | 1.1% Caffeine in core | 2% Caffeine in shell |
| Coalescence Conditions | 75° C., pH = 5.5 | 75° C., pH = 4 | 70° C., pH = 4 | 80° C./pH = 4 | 75° C., pH = 4 | 75° C., pH = 4 |
| Size/GSDv/GSDn | 6.1 μm, 1.21, 1.29 | 5.8 μm, 1.22, 1.24 | 5.7 μm, 1.21, 1.23 | 6.3/1.22/1.21 | 5.5 μm, 1.22, 1.44 | 5.9 μm, 1.23, 1.41 |
| Circularity | 0.991 | 0.981 | 0.971 | 0.987 | 0.970 | 0.967 |
| Surface Morphology | Relatively smooth surface | Relatively smooth surface | Rough surface | Very smooth surface | Slightly rough | Slightly rough |
| Cold Offset Temp (COT) | 123° C. | 123° C. | 116° C. | 126° C. | 123° C. | 124° C. |
| Peak Gloss | 61 | 63 | 60 | 55 | 61 | 65 |
| T40 Gloss | 137° C. | 131° C. | 130° C. | 136° C. | 134° C. | 129° C. |
| MFT | 133° C. | 129° C. | 129° C. | 133° C. | 129° C. | 126° C. |
| Mottle/Hot Offset | 185° C., 185° C. | 189° C., 189° C. | 190° C., 195° C. | 150° C./180° C. | 189° C./194° C. | 186° C./186° C. |
| Blocking Temperature | 55.3° C. | 55.2° C. | 53.5° C. | 54.2° C. | 53.5° C. | 54.3° C. |
| Parent Q/M | 72, 16.7 | 71.1, 11.2 | 65.7, 11.2 | 80.4/11.2 | 84.1, 13 | 63.6, 11.7 |
| Additive Q/M | 64.0, 31.9 | 67.8, 23.9 | 74.5, 30.4 | 58.4/21.4 | 81.0, 32.1 | 69.8, 27.1 |

st-nBAc = poly(strene-n-butyl acrylate)

st-nBAc=poly(styrene-n-butyl acrylate)

All references cited herein are herein incorporated by reference in entirety.

It will be appreciated that several of the above-disclosed and other features and functions, or alternatives thereof, may be desirably combined into many other different systems or applications. Unless specifically recited in a claim, steps or components of claims should not be implied or imported from the specification or any other claims as to any particular order, number, position, size, shape, angle, color or material. Also, various presently unforeseen or unanticipated alternatives, modifications, variations or improvements therein may be subsequently made by those skilled in the art, and are intended to be encompassed by the following claims.

What is claimed is:

1. A composition comprising:

particles having a core and a shell disposed over the core, wherein the core comprises:

a first styrene-acrylate resin; and the shell comprises:

and a second styrene-acrylate resin;

wherein the particles include at least one of a first antiplasticizer in the core or a second antiplasticizer in the shell and further wherein at least one of the first antiplasticizer or the second antiplasticizer comprises a purine or purine derivative.

2. The composition of claim 1, wherein the toner particles have a circularity of from 0.940 to 0.980.

3. The composition of claim 1, wherein the core further comprises a polyester resin.

4. The composition of claim 1, wherein the core comprises the first antiplasticizer in the amount of from 0.1% to 5% by weight of the weight of the toner particles.

5. The composition of claim 1, wherein the shell comprises the second antiplasticizer in the amount of from 0.1% to 5% by weight of the weight of the toner particles.

6. The composition of claim 1, wherein the core comprises the first antiplasticizer and the shell comprises the second antiplasticizer, further wherein the first antiplasticizer is the same or different from the second antiplasticizer.

7. The composition of claim 1, wherein the purine derivative is selected from the group consisting of adenine, guanine, hypoxanthine, xanthine, 1-methylxanthine, 3-methylxanthine, 7-methylxanthine, theophylline, paraxanthine, theobromine, caffeine, uric acid, 1,3,7-trimethyluric acid, theacrine, libertine, methylliberine, isoguanine, and mixtures thereof.

8. The composition of claim 1, wherein the purine derivative comprises caffeine.

9. The composition of claim 1, wherein the core comprises the first styrene-acrylate resin in the amount of from 7% to 60% by weight of the total weight of the composition.

10. The composition of claim 1, wherein the shell comprises the second styrene-acrylate resin in the amount of from 3% to 20% by weight of the total weight of the composition.

11. The composition of claim 1, wherein the first styrene-acrylate resin and the second styrene-acrylate resin are independently selected from the group consisting of stynBAc poly(styrene-n-butyl acrylate), poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (alkyl acrylate-acrylonitrile-acrylic acid), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), poly(styrene-1,3-diene), poly (styrene-1,3-diene-acrylic acid), poly (styrene-1,3-diene-acrylonitrile-acrylic acid), poly(styrene-butadiene), poly (methylstyrene-butadiene), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl methacrylate-acrylic acid), poly(butyl methacrylate-butyl acrylate), poly (butyl methacrylate-acrylic acid), poly(acrylonitrile-butyl acrylate-acrylic acid), and mixtures thereof.

12. The composition according to claim 1, wherein both the first styrene-acrylate resin and the second styrene-acrylate resin each comprises a styrene alkyl acrylate polymer.

13. The composition according to claim 1, wherein the styrene-acrylate resin of at least one of the core or the shell has a weight-average molecular weight (Mw) value ranging from 15k to 70k.

14. The composition according to claim 1, wherein the styrene-acrylate resin of at least one of the core or the shell has a number-average molecular weight (Mn) value ranging from 10k to 60k.

15. The composition according to claim 1, wherein the styrene-acrylate resin of at least one of the core or the shell has a polydispersity index (Mw/Mn) value ranging from 1.5 to 10.

16. The composition of claim 3, wherein the polyester resin comprises a crystalline polyester resin and an amorphous polyester resin.

17. A toner composition comprising toner particles having a core and a shell disposed over the core, wherein the core comprises:

caffeine in the amount of from 0.1% to 5% by weight of the total weight of the toner particles;

a first styrene-acrylate resin;

a polyester resin; and the shell comprises:

caffeine in the amount of from 0.1% to 5% by weight of the total weight of the toner particles; and a second styrene-acrylate resin.

18. A method of making a plurality of toner particles comprising providing an emulsion comprising a resin, an optional colorant, and an optional wax, and a first antiplasticizer, wherein the resin comprises a first styrene-acrylate resin and a polyester resin;

aggregating the emulsion to form particle cores;

forming a shell over the particle cores to form particles, wherein the shell comprises a second antiplasticizer and a second styrene-acrylate resin; and coalescing the particles at a temperature from 65° C. to 80° C., and pH from 3.5 to 6.0;

wherein at least one of the first antiplasticizer and the optional second antiplasticizer comprises a purine derivative, further wherein the toner particles having a circularity of from 0.955 to 0.980.

19. The method of claim 18, wherein the core comprises the first antiplasticizer in the amount of from 0.1% to 5% by weight of the weight of the toner particles, and the shell comprises the second antiplasticizer in the amount of from 0.1% to 5% by weight of the weight of the toner particles.

20. The method of claim 18, wherein the core comprises the first styrene-acrylate resin in the amount of from 20% to 60% by weight of the total weight of the composition; and the shell comprises the second styrene-acrylate resin in the amount of from 5% to 20% by weight of the total weight of the composition.

* * * * *